US008261684B2

(12) United States Patent
Werner

(10) Patent No.: US 8,261,684 B2
(45) Date of Patent: Sep. 11, 2012

(54) SHOCK ABSORBING COCKPITS

(76) Inventor: Todd C. Werner, Clearwater, FL (US)

( * ) Notice: Subject to any disclaimer, the term of this patent is extended or adjusted under 35 U.S.C. 154(b) by 47 days.

(21) Appl. No.: 12/366,924

(22) Filed: Feb. 6, 2009

(65) Prior Publication Data

US 2010/0199908 A1 Aug. 12, 2010

(51) Int. Cl.
*B63B 17/00* (2006.01)

(52) U.S. Cl. ..... 114/363; 114/71

(58) Field of Classification Search ..... 114/71, 114/343, 363, 364; 267/131, 132, 133; 297/195.1, 297/195.11; 248/636
See application file for complete search history.

(56) References Cited

U.S. PATENT DOCUMENTS 5,207,408 A * 5/1993 Burg ..... 248/550
6,786,172 B1 * 9/2004 Loffler ..... 114/363
6,889,625 B1 * 5/2005 Loffler ..... 114/363
H2229 H * 2/2009 Reason ..... 114/71
2007/0204786 A1 * 9/2007 Boehler ..... 114/364

FOREIGN PATENT DOCUMENTS

WO 2005025975 3/2005

* cited by examiner

*Primary Examiner* — Lars A Olson
(74) *Attorney, Agent, or Firm* — Williams Mullen

(57) ABSTRACT

A watercraft cockpit includes a floor, sidewalls and forward and rearward bulkheads. A frame assembly having four corners supports the cockpit and includes an upper frame and a lower frame that are rotatably connected to one another. A pair of shock-absorbing members is provided at each of the four corners of the frame so that the entire cockpit is isolated from shocks. By cushioning the entire cockpit as a whole, the need for individual shock-absorbing seats is obviated. The walls of the cockpit are spaced apart from the sidewalls of the watercraft and are interconnected to the sidewall of the watercraft by a flexible member so that the sidewalls of the watercraft move up and down in response to shocks independently of the walls of the cockpit. Each shock-absorbing member preferably includes an airbag and a dashpot but other shock-absorbing members are within the scope of the invention.

15 Claims, 8 Drawing Sheets

FIG. 4
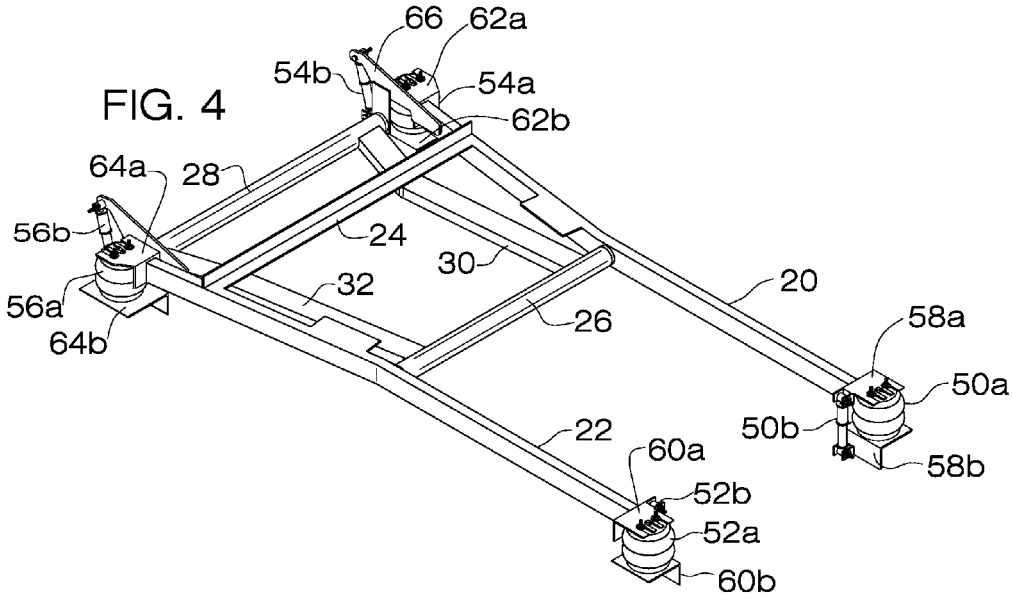
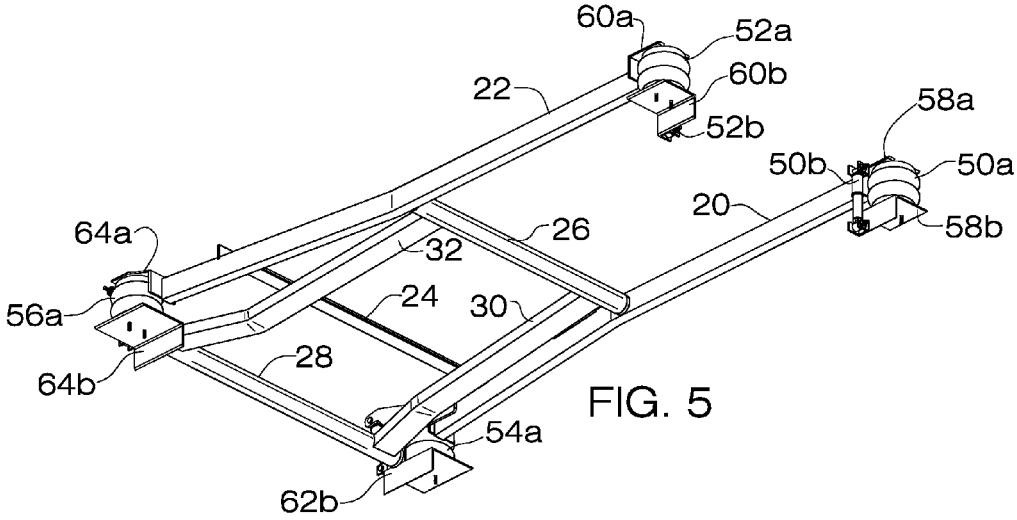
FIG. 5

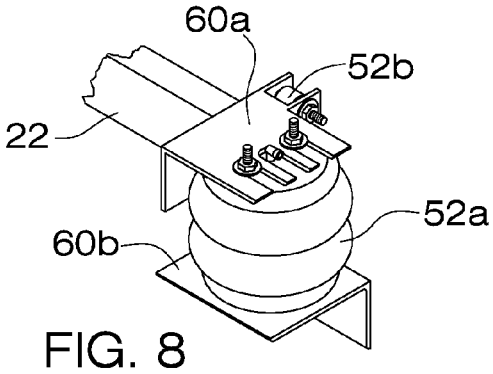
FIG. 8
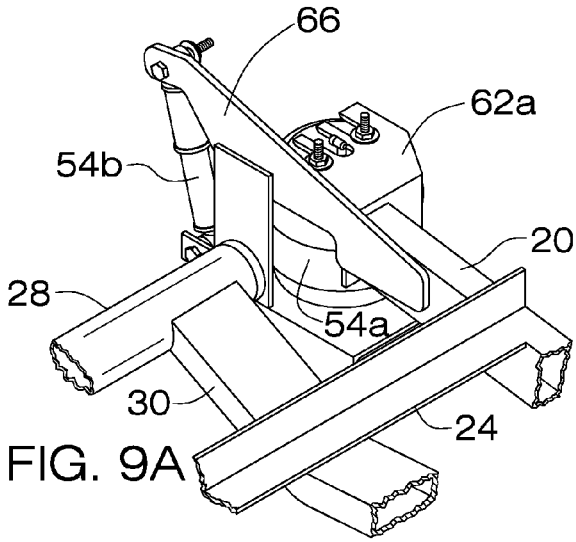
FIG. 9A
FIG. 9B
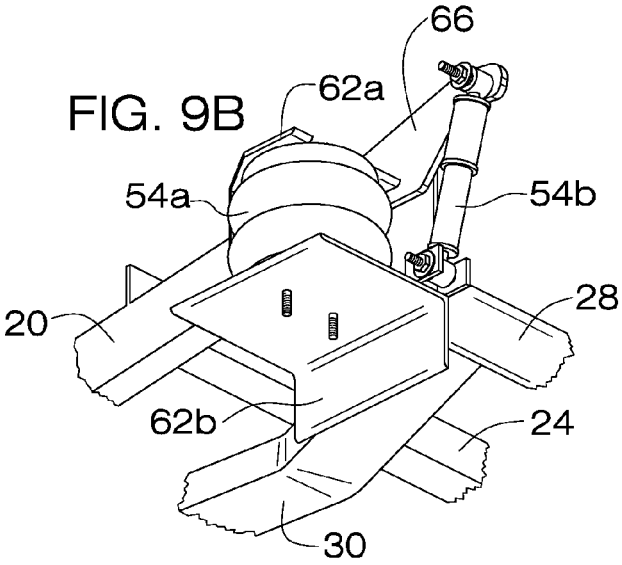
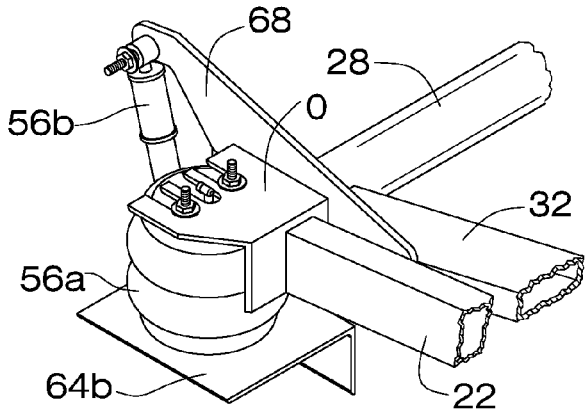
FIG. 10

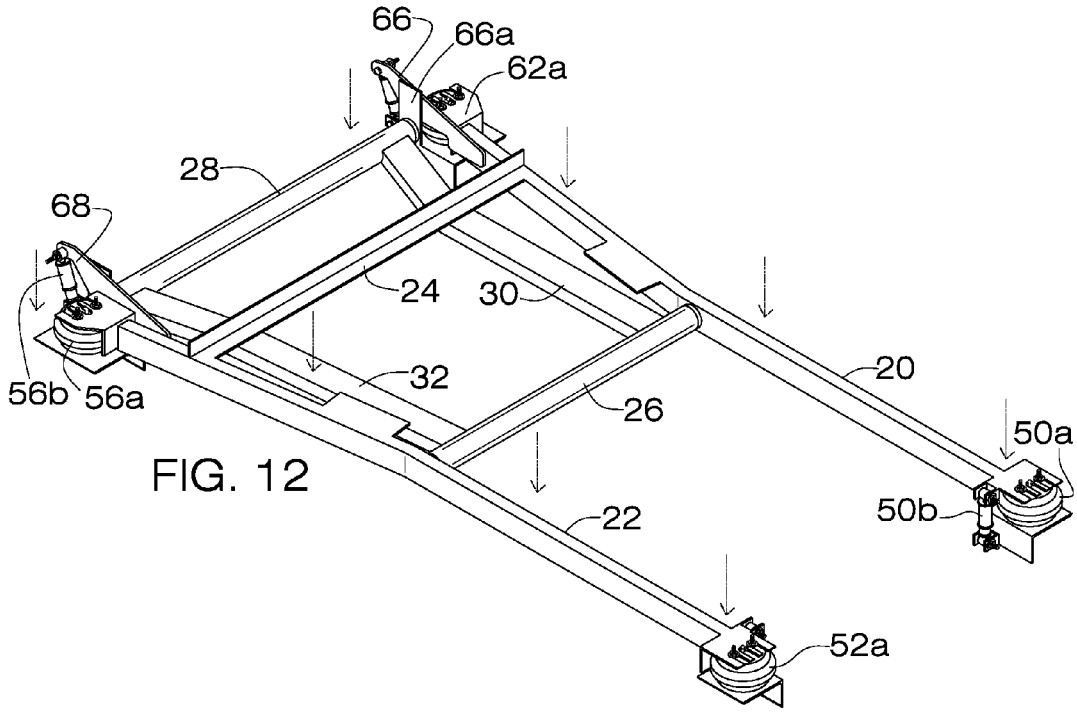
FIG. 12
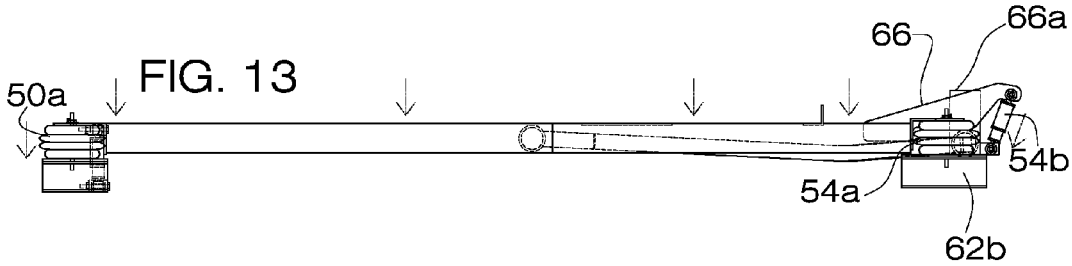
FIG. 13
FIG. 14
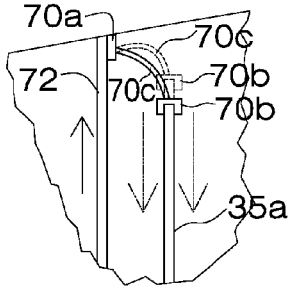

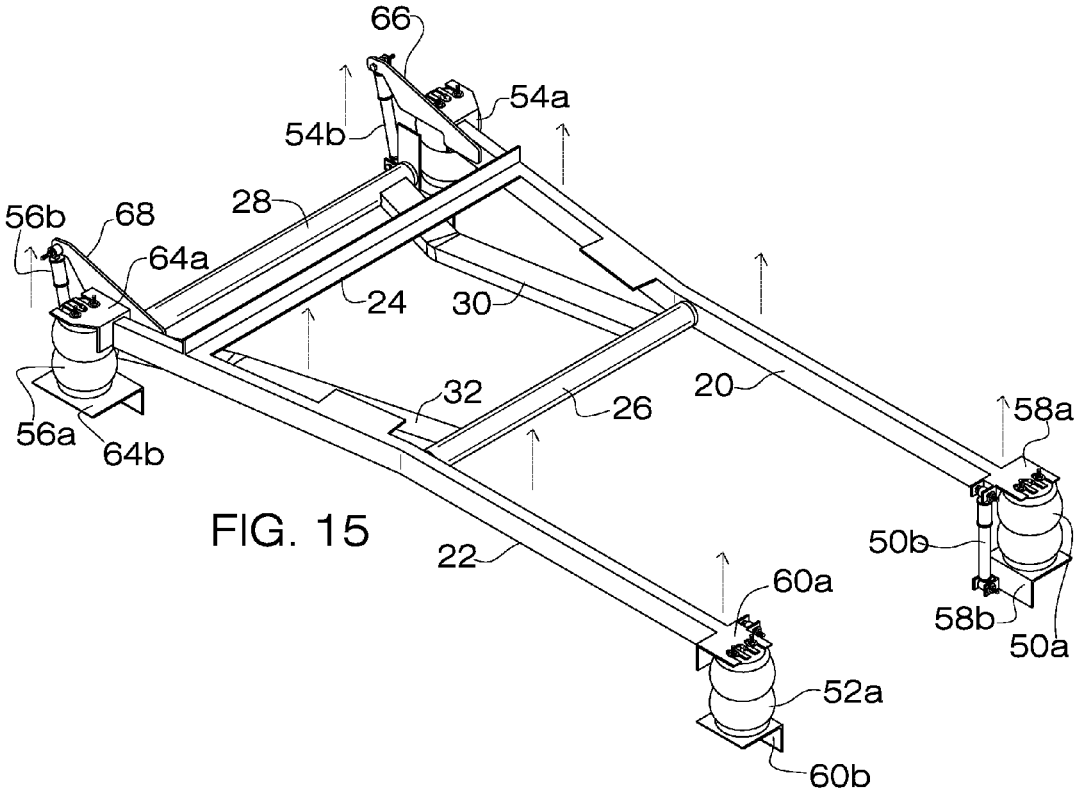
FIG. 15
FIG. 16
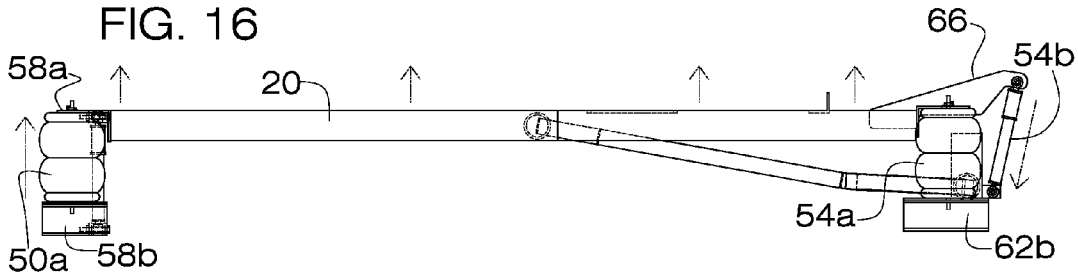
FIG. 17
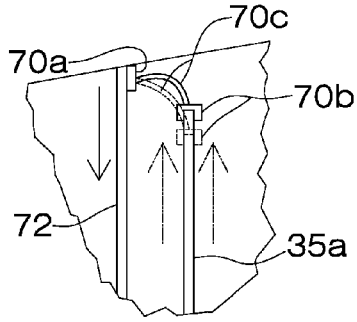

SHOCK ABSORBING COCKPITS

BACKGROUND OF THE INVENTION

1. Field of the Invention

This invention relates, generally, to boats. More particularly, it relates to shock-absorbing means for the cockpit of a speedboat or the pilot's lounge of a pleasure craft.

2. Description of the Prior Art

Occupants of a speedboat, whether a driver, navigator, throttleman, or passenger, are confined for safety purposes in a cockpit which may be closed or open. A closed cockpit is a full enclosure including a floor, walls, and ceiling whereas an open cockpit may lack a ceiling or walls that extend all the way to an overhead cover.

The pilot's lounge of a slower pleasure boat has much the same structure as a speedboat cockpit. The different names for essentially the same structure arise primarily because the high speeds attained by speedboats make the name cockpit more suitable instead of the more leisurely-sounding pilot's lounge.

Occupants of the cockpit, whether the cockpit is open or closed, and whether the occupants are standing or sitting, experience severe shocks at high speeds. Even at much lower speeds, intense shocks can occur in high seas. For example, there is a large impact when a boat drops from a four foot wave into a trough at any speed.

Such shocks can cause spinal pain or injury and can jar the internal organs. The number of shocks encountered during a race or a slower cruise in heavy seas can be very high.

The conventional response to the problem is to provide individual seats that are equipped with padded seat and back cushions, shock-absorbing coil springs, leaf springs, or gas-filled shock absorbers for supporting the seat, and the like. These measures provide some relief, but they do not adequately solve the problem.

Such shock-absorbing seats are also somewhat undesirable because they are bulky, unattractive, heavy, and expensive.

Thus, there is a need for a shock-absorbing means that cushions the occupants of a speedboat cockpit to a much greater degree than provided by conventional means.

There is also a need for a shock-absorbing means that enables a boat buyer to purchase a boat having ordinary comfortable seats that are neither bulky, unattractive, heavy, nor expensive.

The steering means and other mechanical or electrical components of a dashboard/console are also subjected to shocks at high speeds.

Accordingly, there is a need for a means that protects the steering means and other mechanical or electrical and electronic components that form a part of the cockpit.

Some fishing boats have no passenger seats so there is also a need for a means that protects standing passengers from shocks.

Even fish in a live bait well can be subjected to strong shocks, causing premature demise; thus there is a need for a means for cushioning live bait wells from shocks.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for an apparatus that protects objects in a speedboat cockpit, including human and animal occupants as well as inanimate equipment, from shocks is now met by a new, useful, and non-obvious invention.

The inventive structure contravenes the prior art by not providing improvements to the structure of individual seats. Instead, the invention for the first time anywhere in the world provides a shock-absorbing means for the entire cockpit or pilot's lounge.

The invention may also provide protection for preselected sections of the cockpit only and not for the cockpit as a whole. For example, it is within the scope of the invention to protect only the mechanical, electrical and electronic components of a dashboard/console, including a steering mechanism, from shocks. It is also within the scope of the invention to protect only the inanimate objects in a tackle center from shocks, or to protect only the fish in a live bait well from shocks, and so on in any combination. Conversely, it is within the scope of the invention to protect the human occupants only, whether seated or standing, and to provide no shock protection for inanimate objects or animals in any combination.

The invention therefore allows boat buyers to avoid the purchase of expensive, bulky shock-absorbing seats that fall short of providing adequate shock protection. Ordinary, comfortable seats may be chosen instead because the shocks are handled by the cockpit cushioning means, thereby obviating the need for shock-absorbing individual seats.

As a side benefit, the electrical and electronic instruments and associated electrical wiring and printed circuit boards in the cockpit, as well as those who stand but are not seated are also protected by the cockpit cushioning means in the primary embodiment where the entire cockpit is cushioned. Said items or people are of course not protected from shocks when the only shock protection is found in a seat for occupants as in the prior art.

More particularly, in a preferred embodiment, the novel speedboat of the type having a cockpit includes a horizontal frame for supporting the cockpit and a plurality of airbags disposed between the hull and the floor of the cockpit.

The cockpit includes a floor having a transverse leading end, a transverse trailing end, a longitudinally disposed first side, and a longitudinally disposed second side. A first transverse wall or forward bulkhead is mounted to the transverse leading end of the cockpit floor and a second transverse wall or rearward bulkhead is mounted to the transverse trailing end of the cockpit floor. A first longitudinally disposed wall is mounted on the longitudinally disposed first side of the floor and a second longitudinally disposed wall is mounted on the second longitudinally disposed side of the cockpit floor.

In a preferred embodiment, the cockpit is supported by an elongate upper frame having a length slightly less than the floor of the cabin and a lower frame that is rotatably mounted to the upper frame and which has a length or longitudinal extent equal to about half that of the frame floor. The trailing end of the lower frame is substantially coextensive with the trailing end of the upper frame. Accordingly, the leading end of the lower frame is rotatably attached to the stringers of the upper frame about mid-length thereof.

The upper frame includes two (2) stringers that are longitudinally disposed and transversely spaced from one another. The leading or bow end of each stringer is adapted to engage an air bag that resists abrupt motion and a shock absorber that attenuates shocks. The trailing or stern end of each stringer is also adapted to engage an air bag and a shock absorber. A rigid strut interconnects the stringers and maintains their spacing.

The lower frame includes a leading transversely disposed cylindrical member that extends between the stringers of the upper frame in rotatably mounted relation thereto and a trailing transversely disposed cylindrical member that extends between the stringers of the upper frame in rotatably mounted relation thereto. The leading and trailing cylindrical members are interconnected by a pair of transversely spaced apart, longitudinally disposed support members that are coplanar at their respective leading ends with the stringers of the upper frame but spaced inwardly therefrom, i.e., closer to the longitudinal axis of the watercraft. The trailing end of each support member is bent away from said longitudinal axis so that the respective trailing ends of each support member is positioned directly below the respective trailing ends of the stringers of the upper frame. This enables the air bags and shock absorbers to be positioned between top brackets connected to the stern end of the stringers and bottom brackets connected to the stern end of the support members.

The airbags, although preferred, may be replaced by any other suitable shock-absorbing means including coil springs, leaf springs, shock absorbers, air cylinders, solid cushioning means, and the like. In the preferred embodiment, the air bags include automatic leveler means that increase pressure when a load is increased or decrease pressure when a load is lightened.

An important advantage of the primary embodiment of the invention is that it protects the cockpit as a whole against shocks, thereby protecting occupants as well as equipment.

A related advantage is that it obviates the need for expensive shock-absorbing seats.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 4 is a top perspective view of the upper and lower frames that support the cockpit;

FIG. 5 is a first bottom perspective view of the structure depicted in FIG. 4;

FIG. 8 is a perspective view of an airbag and shock absorber assembly at the starboard, bow corner of the novel frame assembly;

FIG. 9A is a first perspective view of an airbag and shock absorber assembly at the port, stern corner of the novel frame assembly;

FIG. 9B is a second perspective view of the structure depicted in FIG. 9A;

FIG. 10 is a second perspective view of an airbag and shock absorber assembly at the starboard, stern corner of the novel frame assembly;

FIG. 12 is a perspective view of the structure depicted in FIG. 14;

FIG. 13 is a side elevational view of the upper and lower frame when the air bags and shock absorbers are fully compressed;

FIG. 14 is a view depicting how a side wall of the cockpit moves downwardly with respect to a side of the watercraft when said airbags and shock absorbers are fully compressed;

FIG. 15 is a perspective view of the structure depicted in FIG. 17;

FIG. 16 is a side elevational view of the upper and lower frame when the air bags and shock absorbers are fully decompressed; and FIG. 17 is a view depicting how a side wall of the cockpit moves upwardly with respect to a side of the watercraft when said airbags and shock absorbers are fully decompressed.

DETAILED DESCRIPTION OF THE PREFERRED EMBODIMENT

Figure 1:
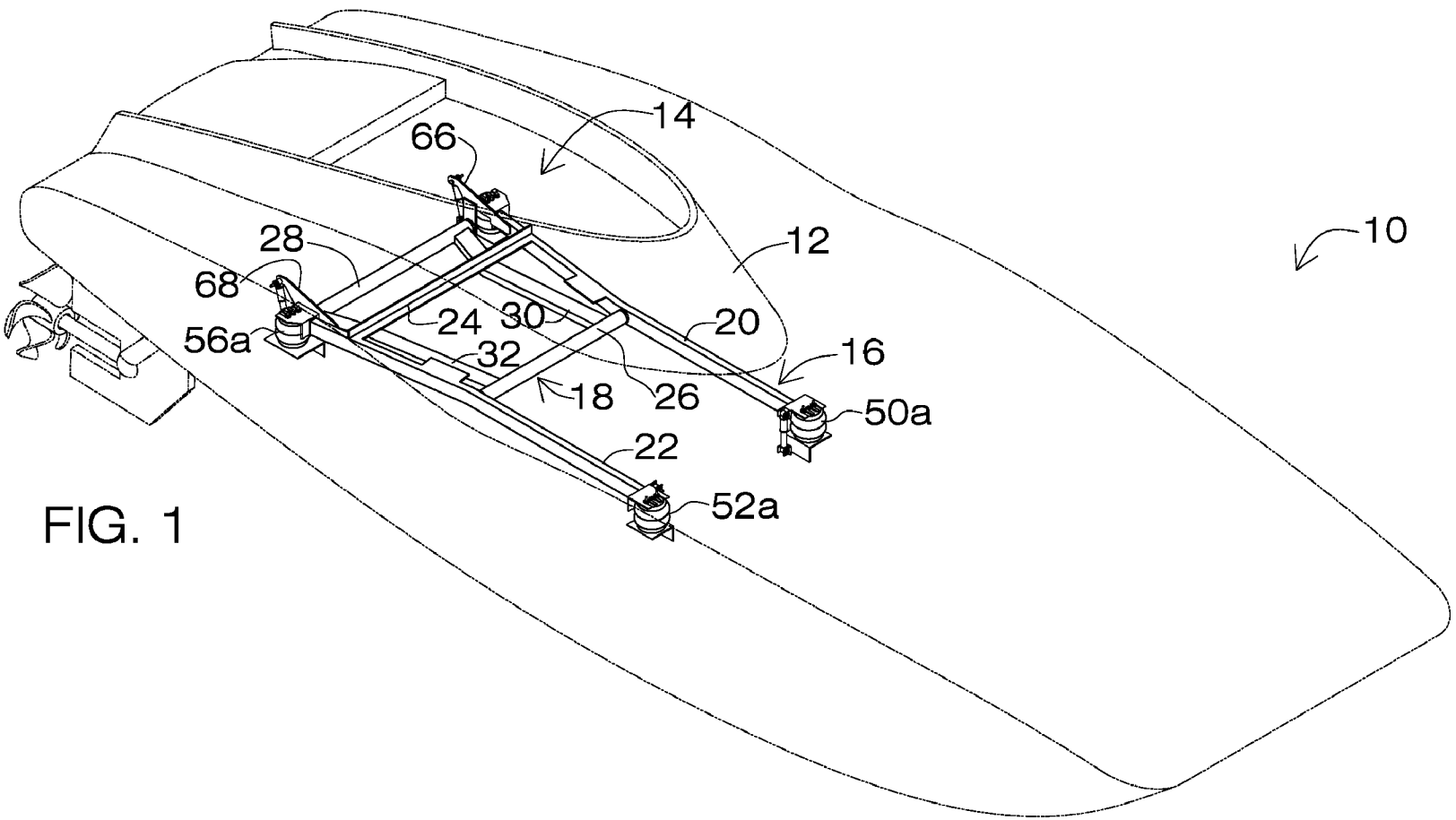
FIG. 1 is a perspective view of a high performance watercraft in phantom lines and the novel structure for supporting a cockpit in solid lines.

Referring now to FIG. 1, it will there be seen that a high performance watercraft equipped with the novel cockpit shock-absorbing means is denoted as a whole by the reference numeral 10.

Watercraft 10 has a windshield 12 and an open cockpit 14 but the invention has equal utility with open or closed cockpits.

The shock-absorbing support structure for the cockpit includes an upper frame denoted 16 as a whole and a lower frame denoted 18 as a whole.

Figure 2:
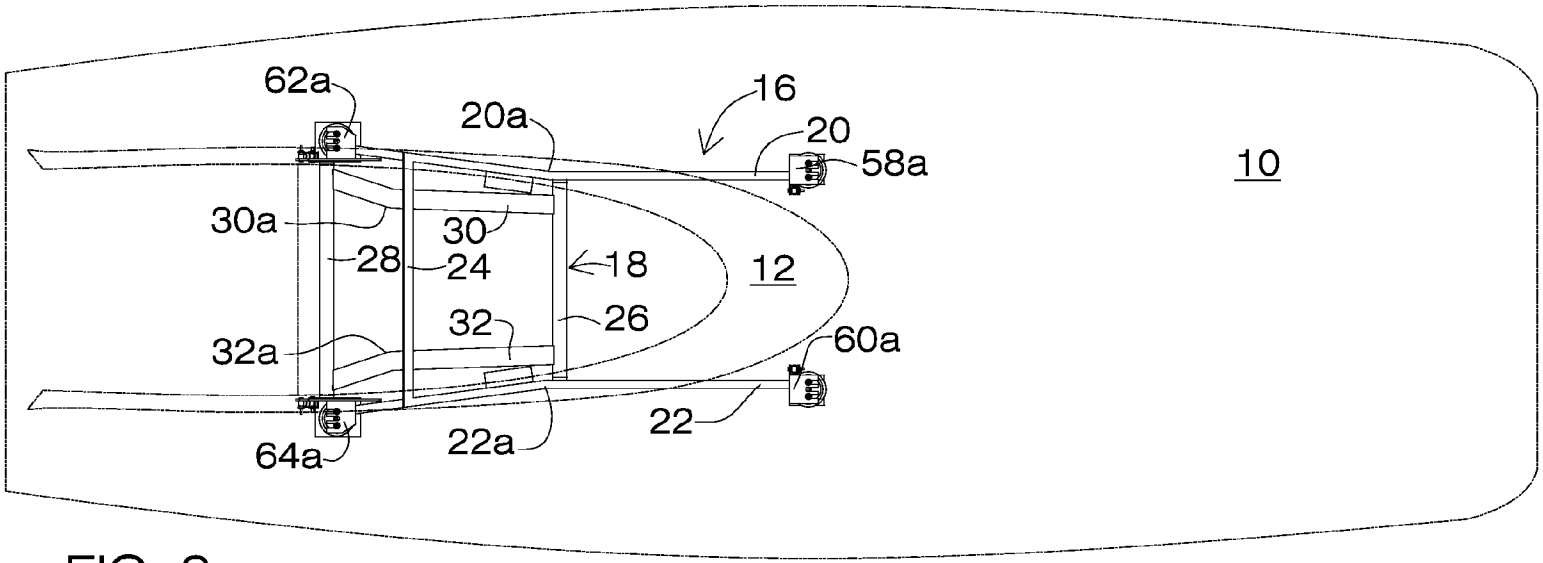
FIG. 2 is a top plan view of the structure depicted in FIG. 1.

As depicted in FIGS. 1 and 2, upper frame 16 includes port stringer 20 and starboard stringer 22. The stringers are parallel to one another and transversely spaced apart from one another, interconnected by transversely disposed angle member 24. Each stringer is bent outwardly as at 20*a*. 22*a* relative to a longitudinal axis of watercraft 10 about mid-length thereof so that the respective trailing ends of the stringers are spaced further apart than the respective leading ends of the stringers.

Lower frame 18 includes leading transverse cylindrical member 26 and trailing transverse cylindrical member 28 that are interconnected to one another by longitudinally disposed support members 30, 32. The respective leading ends of support members 30, 32 are positioned coplanar with stringers 20, 22, inwardly thereof. The respective trailing ends of support members 30, 32 are flared outwardly as at 30*a*, 32*a* with respect to the longitudinal axis of the watercraft and are positioned below the plane of the upper frame.

Figure 3:
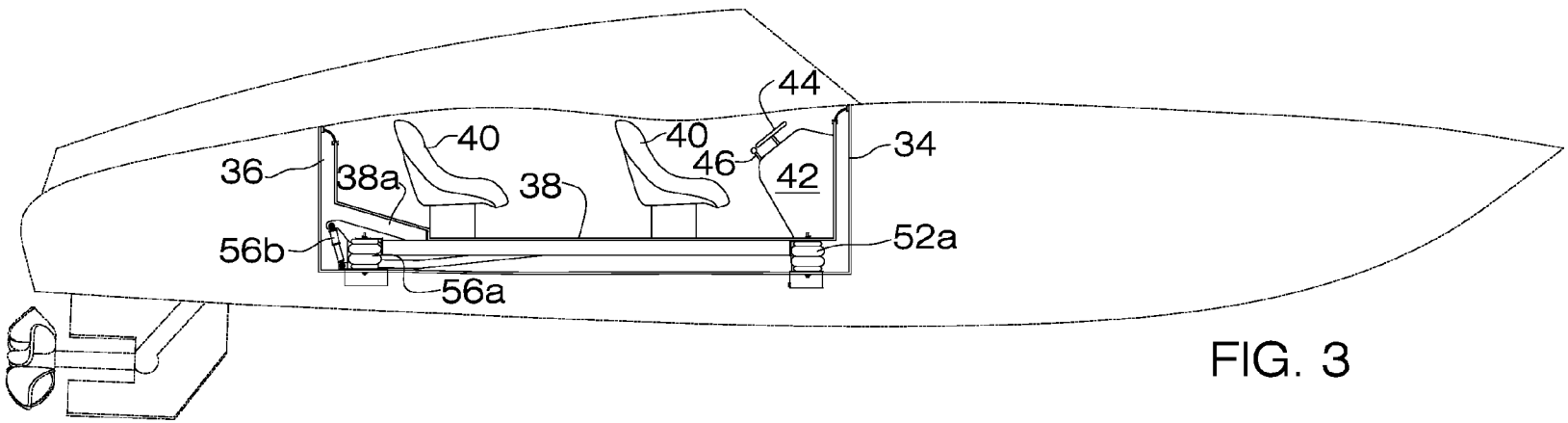
FIG. 3 is a side elevation view of the structure depicted in FIG. 1 and further including the forward and rearward walls of the cockpit.

FIG. 3 depicts forward cockpit wall or bulkhead 34 and rearward cockpit wall or bulkhead 36. The floor of the cockpit is generally denoted 38. An inclined part thereof accommodates the parts of the novel shock-absorbing apparatus near the trailing end of the cockpit and is denoted 38*a*. Seats for passengers, a pilot or captain, a navigator, a throttleman, etc., are collectively denoted 40. The invention performs equally well in watercraft having no seats; standing passengers or animals or inanimate objects are protected as well as seated passengers. Dashboard 42 includes a wheel 44, a throttle 46, and numerous electronic components that are protected from shocks by the novel structure. Not depicted in FIG. 3 are the longitudinally disposed walls of the same height as transversely disposed bulkheads 34, 36. Said nondepicted walls are not connected to the sides of the watercraft as in a conventional watercraft where the sides of the boat are the sides of the cockpit. Accordingly, the entire cockpit, including floors, walls, seats, and dashboard, are protected from shocks during high speed travel. However, it is within the scope of this invention to eliminate one or more of the upstanding walls that border the cockpit. Accordingly, a cushioned cockpit floor having no walls is within the scope of this invention, as is a cockpit floor having at least one sidewall secured to it.

Figure 6:
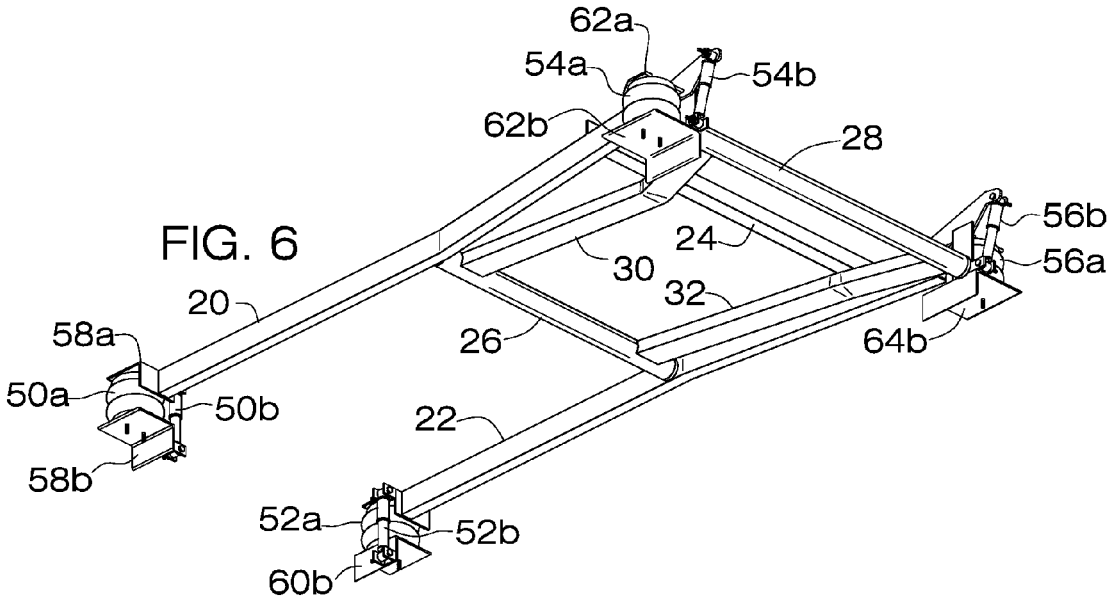
FIG. 6 is a second bottom perspective view of the structure depicted in FIG. 4.

As indicated in FIGS. 4-6, an air bag 50*a* and dashpot or shock absorber 50*b* are mounted to a leading end of port stringer 20, i.e., at the port and bow corner of the frame assembly. Air bag 52*a* and shock absorber 52*b* are mounted to a leading end of starboard stringer 22, i.e., at the starboard and bow corner of the frame assembly. Air bag 54*a* and shock absorber 54*b* are mounted to a trailing end of port stringer 20, i.e., at the port and stern corner of the frame assembly, and air bag 56*a* and shock absorber 56*b* are mounted to a trailing end of starboard stringer 22 i.e., at the starboard and stern corner of the frame assembly.

Figure 7A:
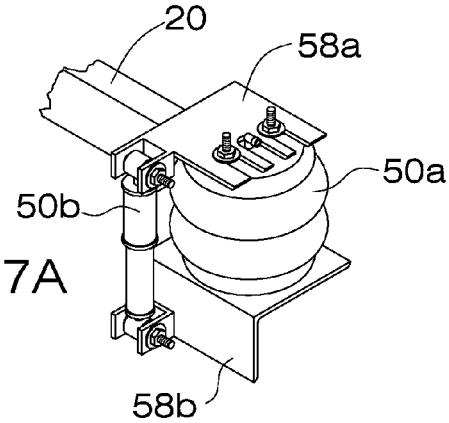
FIG. 7A is a first perspective view of an airbag and shock absorber assembly at the port, bow corner of the novel frame assembly.
Figure 7B:
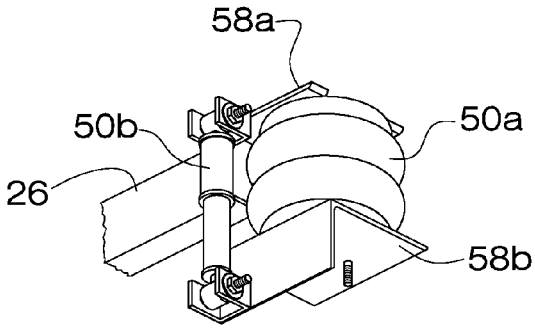
FIG. 7B is a second perspective view of the structure depicted in FIG. 7A.

As best depicted in FIGS. 7A and 7B, airbag 50*a* is sandwiched between two (2) angle brackets 58*a* and 58*b*. A horizontal wall of upper angle bracket 58*a* is slotted; two (2) of the slots receive nuts, bolts and washers to secure the airbag to the bracket and a third slot accommodates a valve body through which air from a remote source of air under pressure, not depicted, is connected. A vertical part of upper angle bracket 58*a* is secured to the leading end of port stringer 20. As understood more clearly in connection with FIGS. 7-12, the upper end of shock absorber 50*b* is secured to upper angle bracket 58*a* and the lower end of said shock absorber is secured to lower bracket 58*b*.

As best depicted in FIG. 8, airbag 52*a* is sandwiched between two (2) angle brackets 60*a* and 60*b*. The structure of angle brackets 60*a* and 60*b* is the same as that of angle brackets 58*a*, 58*b*. The upper end of shock absorber 52*b* is secured to upper angle bracket 60*a* and the lower end of said shock absorber is secured to lower bracket 60*b*.

As best depicted in FIGS. 9A and 9B, rear airbag 54*a* is sandwiched between two (2) angle brackets 62*a* and 62*b*. The structure of angle brackets 62*a* and 62*b* is substantially the same as that of angle brackets 58*a*, 58*b*. However, the upper end of shock absorber 54*b* is secured to the trailing end of rigid plate 66 that is positioned in a vertical plane and secured to a trailing end of port stringer 20. Said trailing end is positioned upwardly of upper angle bracket 62*a*. A second rigid flat plate 66*a*, also disposed in a vertical plane, is secured to rigid flat plate 66 and depends therefrom. Trailing transverse cylindrical member 28 has one end rotatably mounted to said second rigid flat plate 66*a*. It should be clear that said first and second rigid flat plates could be integrally formed with one another, i.e., said second rigid flat plate may be obviated and said first rigid flat plate formed to have a downwardly extending part to which the port end of trailing transverse cylindrical member 28 is rotatably mounted. The lower end of shock absorber 54*b* is secured to a shackle that is secured to lower bracket 62*b*.

As best depicted in FIG. 10, airbag 56*a* is sandwiched between two (2) angle brackets 64*a* and 64*b*. The structure of angle brackets 64*a* and 64*b* is the same as that of angle brackets 58*a*, 58*b*. The upper end of shock absorber 56*b* is secured to the trailing end of rigid flat plate 68 that is positioned in a vertical plane and secured to the trailing end of starboard stringer 22. Said trailing end is positioned upwardly of upper angle bracket 64*a*. The starboard end of trailing transverse cylindrical member 28 is rotatably secured to a second rigid flat plate 68*a* or a downwardly-extending integral part of rigid flat plate 68. The lower end of shock absorber 56*b* is secured to a shackle that is secured to lower bracket 64*b*.

Figure 11:
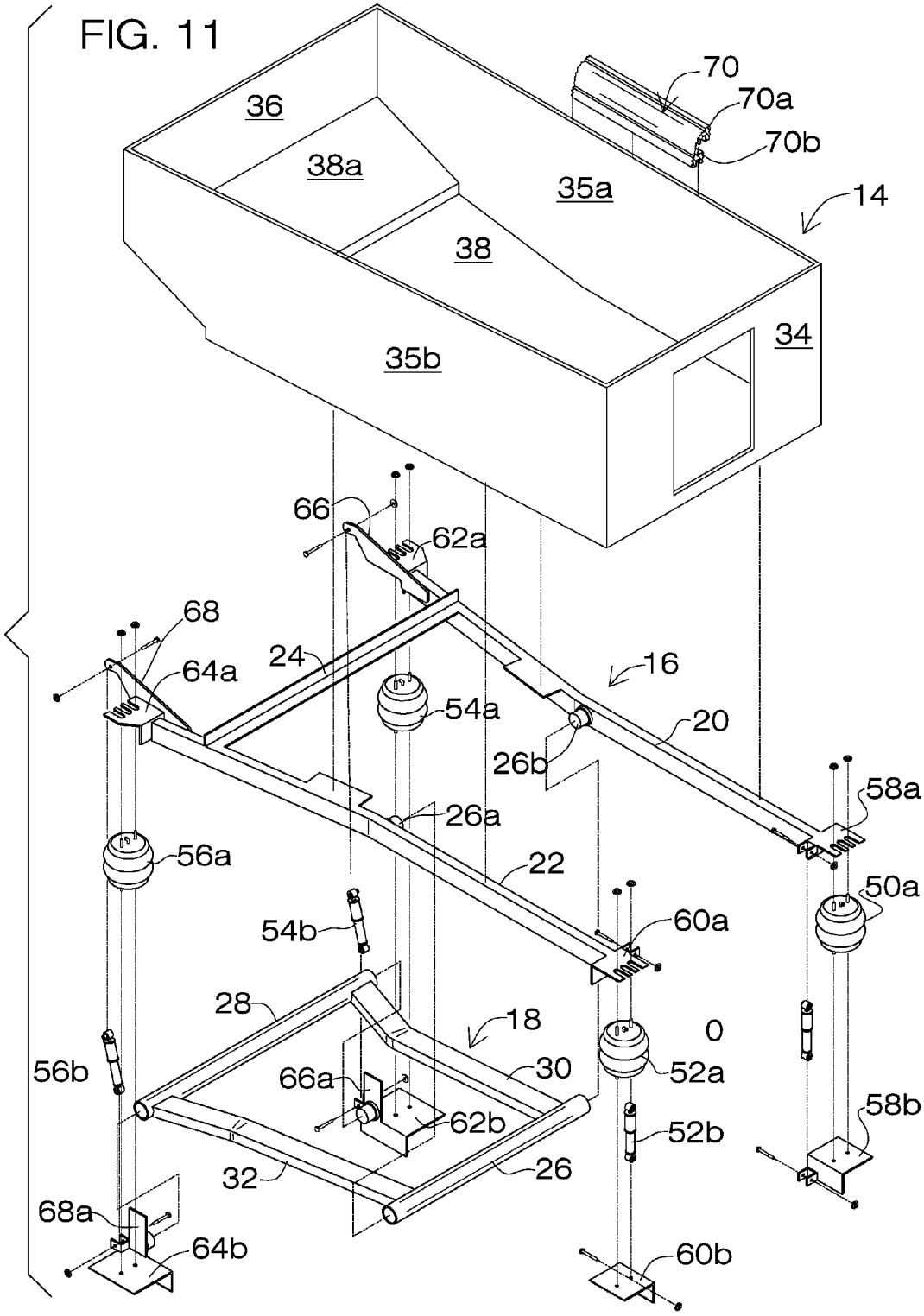
FIG. 11 is an exploded view depicting the cockpit, the upper frame member, the lower frame member, and related parts.

FIG. 11 is an exploded view. Most of the parts connected to upper and lower frames 16 and 18 have been disclosed, as have most of the parts associated with cockpit 14. Transversely opposed protuberances 26*a*, 26*a* on the inboard side of stringers 20, 22 provide the rotatable mount for leading cylindrical member 26 as indicated by the assembly lines. Similarly, transversely opposed protuberances 28*a*, 28*a* on the inboard side of rigid flat plates 66*a*, 68*a* provide the rotatable mount for trailing cylindrical member 28 as also indicated by said assembly lines.

Part 70 at the upper end of FIG. 11 is a flexible member having the same length as the longitudinally disposed walls of cockpit 14. Top edge 70*a* of part 70 is secured to a sidewall of the watercraft near the top edge or gunwale thereof. Bottom edge 70*b* is adapted to be secured to an upstanding sidewall 35*a* of the cockpit. Flexible strip 70*c* interconnects top edge 70*a* to bottom edge 70*b*. Flexible member 70 is an integrally formed part. There are two of such flexible parts, only one of which is depicted to simplify the drawing. The undepicted part interconnects longitudinal wall 35*b* of cockpit 14 to a sidewall of the watercraft. The operation of part 70 is best understood in connection with FIGS. 14 and 17. Flexible part 70 covers the gap between the cockpit sidewalls and the sidewalls of the watercraft to allow relative movement between the cockpit and watercraft sidewalls while protecting said occupants from such relative motion.

FIGS. 12-14 depict upper and lower frames 16 and 18 when watercraft 10 is impacted by waves at high speed. Note in FIGS. 12 and 13 that all four (4) airbags and shock-absorbers are fully compressed. As indicated in FIG. 14, this causes sidewall 72 of watercraft 10 to move upwardly with respect to cockpit wall 35*a*. The relative motion of cockpit wall 35*a* is therefore down as indicated by the downwardly directed directional arrows in said Fig. It is significant, however, that cockpit wall 35*a* does not move downwardly; it is outside wall 72 of the watercraft that moves upwardly.

The opposite movement is depicted in FIGS. 15-17. When the watercraft hits a trough, it moves downwardly, thereby relieving the pressure on the airbags and shock-absorbers. The cockpit appears to move up as indicated by the upward directional arrows in FIG. 17 but the actual movement is the downward movement of the sidewalls of the watercraft as the watercraft falls downwardly into the trough.

Although the air bags could be custom designed, it has been found that excellent shock absorption is provided by commercially available airbags of the type installed in vehicles to protect auto passengers during collisions. When positioned as depicted, they collectively absorb the shocks applied to the hull of the watercraft, thereby protecting all of the passengers and equipment within cockpit 14. Accordingly, no special shock-absorbing seats are required.

The novel structure is more effective than individual, especially-designed shock-absorbing seats. All cockpit occupants may relax in inexpensive, commercially available seats without concern for the shocks generated by high speed travel or lower speed travel in heavy seas.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A watercraft having a cockpit, comprising:

said cockpit including a floor having a size coextensive with the size of the cockpit;

said floor being mounted atop a plurality of shock absorbing members to substantially protect said floor from shocks generated by travel of said watercraft through water;

said cockpit being mounted on a frame assembly that includes an upper frame and a lower frame;

said upper frame and said lower frame being pivotally connected to one another;

said frame assembly including four corners, a first corner being a port and bow corner, a second corner being a starboard and bow corner, a third corner being a port and stern corner, and a fourth corner being a starboard and stern corner;

a shock-absorbing means being positioned at each corner of said four corners;

said upper frame including a pair of transversely spaced apart stringers disposed in substantially parallel relation to one another;

said lower frame including a pair of transversely spaced apart support members disposed in substantially parallel relation to one another and positioned between said pair of stringers;

said lower frame further including a first transversely disposed cylindrical member secured to respective leading ends of said support members;

said first transversely disposed cylindrical member having opposite ends rotatably secured to said stringers.

2. The watercraft of claim 1, further comprising:

said floor of said cockpit having at least one upstanding wall secured thereto so that said at least one upstanding wall is substantially protected from said shocks.

3. The watercraft of claim 2, further comprising:

said at least one upstanding wall including a forward wall, a rearward wall, and two sidewalls.

4. The watercraft of claim 2, further comprising:

said watercraft having sidewalls;

said at least one sidewall of said cockpit being spaced apart from said sidewalls of said watercraft;

an interconnecting member having a first end secured to a sidewall of said watercraft, a second end secured to said at least one sidewall of said cockpit, and a flexible web formed integrally with said first and second ends;

whereby said interconnecting member protects occupants of said cockpit from movement of said sidewall of said watercraft.

5. The watercraft of claim 1, further comprising:

said cockpit further including a dashboard/console including controls, said dashboard/console being mounted to said floor so that said dashboard/console is substantially protected from said shocks.

6. The watercraft of claim 1, further comprising:

said cockpit further including at least one passenger seat mounted to said floor so that said at least one passenger seat is substantially protected from said shocks.

7. The watercraft of claim 1, further comprising:

a live bait well secured to said floor for conjoint movement therewith so that live fish in said live bait well are substantially protected from said shocks.

8. The watercraft of claim 1, further comprising:

at least one inanimate object secured to said floor so that said at least one inanimate object is substantially protected from said shocks.

9. The watercraft of claim 1, further comprising:

each shock-absorbing means including an air bag and a dashpot.

10. The watercraft of claim 1, further comprising:

a top angle bracket secured to a leading end of each stringer;

a pair of base angle brackets secured to a hull of said watercraft in transversely spaced apart relation to one another and being disposed beneath and in vertical alignment with an associated top angle bracket;

a pair of said shock-absorbing means having respective first, upper ends secured to said top angle brackets and respective second, lower ends secured to said base angle brackets;

whereby said port and bow shock-absorbing means and said starboard and bow shock-absorbing means attenuate shocks applied to said hull at a bow end of said watercraft.

11. The watercraft of claim 10, further comprising:

a rigid flat plate disposed in a vertical plane and secured to each stringer at its trailing end;

each of said rigid flat plates having a trailing end disposed above said trailing ends of said stringers;

each of said rigid flat plates having a downwardly extending part;

said lower frame further including a second transversely disposed cylindrical member having opposite ends rotatably secured to respective downwardly extending parts of said rigid flat plates.

12. The watercraft of claim 11, further comprising:

said shock-absorbing means at said port and stern corner including an air bag disposed in sandwiched relation between a top angle bracket and a base angle bracket;

said shock-absorbing means at said port and stern corner further including a dashpot having an upper end secured to said trailing end of said rigid flat plate associated with said port and stern corner and having a lower end secured to a shackle secured to said base angle bracket.

13. The watercraft of claim 12, further comprising:

said shock-absorbing means at said starboard and stern corner including an air bag disposed in sandwiched relation between a top angle bracket and a base angle bracket;

said shock-absorbing means at said starboard and stern corner further including a dashpot having an upper end secured to said trailing end of said rigid flat plate associated with said starboard and stern corner and having a lower end secured to a shackle secured to said base angle bracket at said starboard and stern corner.

14. A watercraft having a cockpit, comprising:

said cockpit including a free-floating floor having a size coextensive with the size of the cockpit;

said floor being supported by linkage members that allow the floor to float with at least two degrees of freedom relative to the watercraft when the watercraft is subjected to shocks;

said at least two degrees of freedom including moving up and down and tilting fore and aft about a transverse axis of the watercraft;

said linkage members comprising a longitudinally disposed support member having a trailing end rotatably mounted to the watercraft so as to rotate about a transverse axis and a leading end rotatably mounted to the cockpit floor so as to rotate about a transverse axis;

wherein the cockpit is mounted to the watercraft by a shock absorbing means with the cockpit floor being mounted atop the shock absorbing means; and wherein said linkage members and said shock absorbing means permit the watercraft to move up down, and tilt fore and aft relative to the cockpit.

15. The watercraft of claim 14, further comprising:

said free-floating floor having four corners, each corner being supported by a shock absorbing member to substantially protect said floor from shocks generated by travel of said watercraft through water.

* * * * *